US010405704B2

(12) United States Patent
Shaw

(10) Patent No.: US 10,405,704 B2
(45) Date of Patent: Sep. 10, 2019

(54) TELESCOPIC FOOT AND TOE CLEANER

(71) Applicant: Michael H. Shaw, Plymouth, MA (US)

(72) Inventor: Michael H. Shaw, Plymouth, MA (US)

(73) Assignee: Michael H. Shaw, Plymouth, MA (US)

( * ) Notice: Subject to any disclaimer, the term of this patent is extended or adjusted under 35 U.S.C. 154(b) by 0 days.

(21) Appl. No.: 15/889,820

(22) Filed: Feb. 6, 2018

(65) Prior Publication Data

US 2018/0220851 A1 Aug. 9, 2018

Related U.S. Application Data

(60) Provisional application No. 62/456,208, filed on Feb. 8, 2017.

(51) Int. Cl.
*A47K 7/02* (2006.01)
*A47K 7/04* (2006.01)
(Continued)

(52) U.S. Cl.
CPC ..... *A47K 7/026* (2013.01); *A46B 5/005* (2013.01); *A47K 7/03* (2013.01); *A47K 7/043* (2013.01); *A47K 5/1201* (2013.01)

(58) Field of Classification Search
CPC ..... A46B 5/005; A47K 7/026; A47K 7/043
See application file for complete search history.

(56) References Cited

U.S. PATENT DOCUMENTS 2,641,012 A * 6/1953 Storrs ..... B25G 1/04 15/144.4
3,188,675 A * 6/1965 Beck ..... A47G 25/442 15/144.4

(Continued)

FOREIGN PATENT DOCUMENTS

JP 2006141510 8/2006

OTHER PUBLICATIONS

Amazon, Bath Sponge and Toe Washer Combo, by Preston Inc.
Aidacare Healthcare Equipment, Toe Washer.
Procter Health Care, Toe Washer.

*Primary Examiner* — Randall E Chin
(74) *Attorney, Agent, or Firm* — Cameron LLP

(57) ABSTRACT

A foot and toe washer may have telescopic sections locking into place in an extended state convenient to the user such that not all extensions may be used. Locking mechanisms for locking one extension to another internal extension may comprise a spring-loaded ball and associated orifice or extensions having larger or smaller diameters at ends with rough surfaces so the extensions lock into place by friction when used or comprise twisting grooves on the surfaces of two extensions. In one embodiment, the foot and toe washer is preferably made of strong, light-weight plastic or hard, tough rubber and may have a rubber-coated handle with the extensions extending therefrom as desired. The furthest extension from the handle may have a connecting and locking mechanism of the spring-loaded ball and orifice type or the friction type to connect one of a sponge, a between-the-toes washer, a brush or wash cloth or combination thereof. The sponge may have an associated soap or medicated soap dispenser for treating athlete's foot. The handle end may comprise a lanyard for hanging the foot and toe washer in a shower or locker or a wristlet for carrying the foot and toe washer in the shower.

19 Claims, 8 Drawing Sheets

(51) Int. Cl.

| | |
|---|---|
| ***A46B 5/00*** | (2006.01) |
| ***A47K 7/03*** | (2006.01) |
| *A47K 5/12* | (2006.01) |

(56) References Cited

U.S. PATENT DOCUMENTS

| | | | | | |
|---|---|---|---|---|---|
| 4,135,274 | A * | 1/1979 | Freeman | A45D 34/04 | 15/144.4 |
| 4,866,809 | A * | 9/1989 | Pelletier | A46B 5/0033 | 15/167.1 |
| 5,511,269 | A * | 4/1996 | Watson | A46B 5/0033 | 15/22.1 |
| 5,568,669 | A * | 10/1996 | Godown | A45D 34/04 | 132/320 |
| 5,661,868 | A * | 9/1997 | Panagakos | A46B 5/0033 | 15/144.4 |
| 9,248,564 | B1 * | 2/2016 | Ubeto | B25G 1/04 | |
| 2004/0107976 | A1 | 6/2004 | Lawson et al. | | |
| 2004/0187241 | A1 * | 9/2004 | Katz | A46B 5/0033 | 15/144.4 |
| 2010/0102584 | A1 * | 4/2010 | Sanchez | B25G 1/04 | 294/51 |

* cited by examiner

TELESCOPIC FOOT AND TOE CLEANER

This application claims the benefit of priority to U.S. Provisional Patent Application Ser. No. 62/456,208 filed Feb. 8, 2017 by the same inventor.

FIELD OF THE INVENTION

The present invention generally relates to the technical field of apparatus and methods for washing feet and toes in particular and, more particularly, to a foot and toe cleaner with a sponge and between-the-toes cleaner attachment and a telescopic body that can be extended in length to reach from handle to feet for users of varying height such that users may wash their feet, for example, while standing in the shower.

BACKGROUND OF THE INVENTION

People of all ages and gender have the undesirable task of dealing with dirty feet, fungal infections, and athlete's foot at some stage of their life. Community showers are frequently used in men's and women's locker rooms and residual dirty shower water can remain in the shower from prior users and cause fungal and other diseases, for example, athlete's foot. Ages affected range from teens to senior citizens. There are over approximately three million cases of athlete's foot alone every year.

Spas and certain sports clubs have individual showers but typically provide small lockers for storing one's personal clothing as well as any accessories. Consequently, these small lockers provide very little room to contain a known foot and toe washer which is known to extend approximately three to four feet in length. Consequently, users of known foot and toe washers must bring their foot and toe washers to the sports club each time they use it for lack of storage space.

Athletes, industrial workers, even business people with long commutes are susceptible to athlete's foot. No one on the planet has the luxury of not washing their feet. Coincidentally, this can be one of, if not the most cumbersome, parts of the body to thoroughly wash. However, if foot-washing were made easier, preventative maintenance in regard to foot care can be done with ease. In turn, this would lead to a lesser chance of encountering nasty fungal infections or skin rashes and allow for a more pleasant lifestyle.

The main problem that leads to foot and toe neglect, lack of cleanliness, athlete's foot disease contaminated water and more severe foot related medical conditions requiring frequent cleansing is simply due to difficulty and lack of convenience. Many people do not have large showers. Leaning over on a slippery surface in a small shower stall to wash your feet with a bar of soap can be somewhat awkward and is not ideal. Most of the time, an individual may need to prop their foot up on the side of the bathtub, to spill water onto the floor, to lean on the shower walls for support, or to crouch down in an uncomfortable position to wash their feet. For those who work long days, suffer from soreness, muscle strain, back or neck injuries and senior citizens who may fear slipping and falling in the shower because they cannot easily reach their feet, known methods of washing feet create a serious problem. Additionally, our generation is always looking for something to be more efficient and convenient.

Athlete's foot derives its name from the great number of community showers in sports facilities where men's and women's showers comprise rooms of showerheads and a common drain. For example, in high schools and colleges, community showers serve many students, and the dirty shower water on the floor of the community shower is allowed to stand, be exposed to the air and germs and permit the growth of fungi. So while small showers and bath tubs can create a problem, so can large community showers.

Toe washers without a telescopic handle are known in the art. For example, a foot and toe scrubber with a long, curved handle and a scrubber on one end is disclosed in published U.S. Patent Application, Pub. No. US2004/0107976 by Lawson et al. A similar design is disclosed in published Japanese patent application No. JP2006-141510. A bath sponge and toe washer combination sold by Preston Inc. is available on Amazon, and other foot washers are available from Aidacare Healthcare Equipment, Toe Cleaner, and Procter Health Care. These toe washers are not telescopic.

An example of a telescopic mirror 100 is shown in FIG. 1 available from Blue-Point USA, model 225. There is a handle 110 and a first extension 112 which is external to a plurality of internal extensions 114. The first extension 112 may be extended only as long as its length and typically is gripped by the handle 110 using friction between the handle 110 and the end of the first extension 112. This telescopic mirror 100, 120 appears to have a total of seven extensions 110, 112, 114 which may be easily extended. The extensions are probably held when extended by friction between tapered ends of the extensions to one another. The mirror 120 may mounted so as to be held by a clamp in one position to a final extension and may be used as a spy device for looking around corners or for similar uses.

A tree or bush trimmer is also known for trimming trees of dead branches having two long extensions, the second pull-out extension has a saw attachment and a clipper with a string pull to snip branches. This tree trimmer is extendable to approximately twelve feet in length. Each extension has a tapered out inside extension and a tapered inward outside extension so that they may be held together by friction by extending and twisting the extensions to be held together by friction similarly to the extendable mirror 100 of FIG. 1.

Another known mechanism seen in FIG. 2A in unlocked state and in FIG. 2B in locked state that is known for locking extensions together in place is a ball held by a spring to an inside extension. The ball rides along the extension until it is pushed by the spring into a slot or orifice. The ball is thus locked into place (and extension) by moving the extension and spring-loaded ball into an orifice of an outside extension. Attachments to vacuum cleaners and to extend the length of vacuum cleaner handles, for example, have this spring ball and socket feature.

An extendable heavy baton for subduing criminals is known manufactured by Smith and Wesson. The single baton has three weighted extensions and may lock into place using the spring ball and orifice method "with the flip of the wrist." It is simply closed to its shorter length by pushing the baton against the wall or the floor possibly to release the spring ball and orifice lock. Once the spring ball and lock are released, the baton can reach its intended length. This baton has no means to attach another device to it. The baton is simply for subduing a criminal, and its shorter, non-extended length makes it more portable.

Umbrellas that spring open at the touch of a button may use the spring-loaded ball and orifice method or a spring-loaded, thin triangular metal member and slot method. There are strings attached to a known Burberry umbrella that pull on the umbrella to open the umbrella at the same time as springs open the extensions to lock into place. But an umbrella is not a foot and toe washer. Consequently, there is a need in the art for an extendable foot and toe washer that may share the features of a telescopic design with the concept of attachable sponges, or wash cloths or other foot and toe cleaning apparatus. Band-Aid brand wound bandages may be pre-medicated or adaptable to have particular medication (for Athlete's foot or for medicating a wound such as a blister, sore or open wound). A known sponge or washcloth may be used to apply soap to one's skin when the sponge is wet. These known devices of a wash cloth and a telescopic handle provide the advantage of greater portability, ease of use and easier storage but are not known in combination. However, it also would be desirable to be able to open a foot washer to different lengths, include a washer that may also medicate, if necessary, so that the foot and toe washer, for example, may be shortened to wash one's back and lengthened to reach places on the body more distant and harder to reach such as the feet and toes and long enough and so equipped to serve the particular purpose of a foot and toe washer (and back washer) and medicine applicator.

SUMMARY OF THE INVENTION

The present invention is designed to make cleaning the hard-to-reach gaps between a person's toes as well as one's legs and the tops and the palms of a person's feet easier. A further embodiment permits opening to different lengths for use to wash one's back and any other hard-to-reach part of the body including one's legs. Its telescopic design allows it to extend to a length that will allow people of all shapes and sizes the convenience of standing up in a small shower and washing their back, legs, toes and feet with ease. The present invention also features interchangeable cleaning accessories which may comprise various sponges, wash cloths and washing devices and may include containers for pre-loaded soaps, medications or specialty cleansers, oils and lotions.

These and other features of the present invention will be made clear from the Brief Description of the Drawings which follows along with the Detailed Description which follows the brief description.

BRIEF DESCRIPTION OF THE DRAWINGS

In FIG. 2B, the ball is pulled into the orifice or slot by pulling one extension away from the other and locking the interior extension to the exterior extension. A similar slot and spring-loaded and hinged elongated thin plastic triangular member which locks into the slot as the extension umbrella expands serves the same purpose and is typically found in folding umbrellas.

DETAILED DESCRIPTION

The present invention is directed to a telescopic foot and toe washer per FIGS. 3-7D. All dimensions shown are exemplary only and may vary depending on a target market for the Toe Jam foot and toe washer such as athletes who may be tall and require more extensions than five shown in FIG. 3 including a handle 310.

Figure 6:
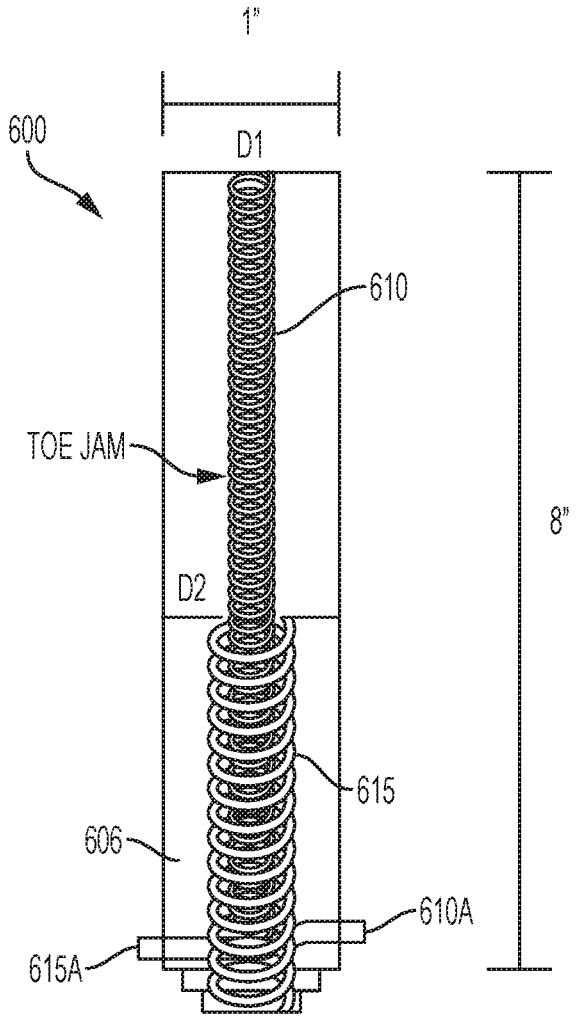
FIG. 6 is a diagram showing an alternative embodiment that is spring-loaded to permit as many extensions as desired (when activated) to move and extend the length of the Toe Jam foot and toe cleaner. The present invention embodiment 600 handle may have a width of one inch. A spring 610 may extend from the top of the handle to the bottom of extension D2. So what is seen in FIG. 6 is that a user has released section D2 to extend to its combined length with extension D1 (for example, to be a back washer). The expansion of D2 to increase the length of D1 to twice D1 is performed by pushing a spring-loaded button. Other spring-loaded buttons 610A and 615A may release further extensions until the Toe Jam foot and toe washer is partially (for washing the back) or fully extended (for washing one's feet or between one's toes). Spring 615, for example, may open to the entire length of the Toe Jam foot and toe washer when spring-loaded push button 615A is pushed releasing enclosed extensions. Push button 610A may release an extension spring to open Toe Jam foot and toe washer to an intermediate length. First handle/extension D1 and D2 with the telescopic remaining portion retracted is shown having an exemplary size of one inch wide by eight inches long and may be expanded three more extension shown or to thirty-two inches, all such sizes being exemplary but the eight inch section intended to easily fit in a typical locker found in a spa or sports club. First and second springs 610, 615 are shown inside one another where an internal, for example, first plastic spring 610 may extend sixteen inches pushing the final toe washer extension to its entire length of, for example, twenty-four to thirty-two inches. This first extension spring 610 will be held by a spring-loaded pin or push-button like push buttons 610A and 615B when retracted and the associated extension spring extends from a compressed length of eight inches to a length of sixteen to twenty-four inches and may have the diameter of the second extension so it pushes against the third extension and may open the foot and toe washer 600 all the way. The other spring 615 may have the diameter of the handle extension at about one inch and only press against the first extension. It may be four inches compressed and extend to eight inches to only open the first/second telescopic extension (for back washing). So opened, the Toe Jam foot and toe washer would have a length of eight, sixteen, twenty-four or thirty-two inches and could be used to reach one's back for washing one's back as well as one's leg or to reach one's feet and between one's toes.

As shown in FIG. 6, a Toe Jam exemplary foot and toe washer 600 may be spring-loaded or not according to the present invention. The Toe Jam foot and toe washer shown in FIG. 6 in the retracted position without any interchangeable accessories connected may extend to any desired length. An exemplary length of a section may be approximately 6-8" or, eight inches shown, up to about twelve inches.

Figure 3:
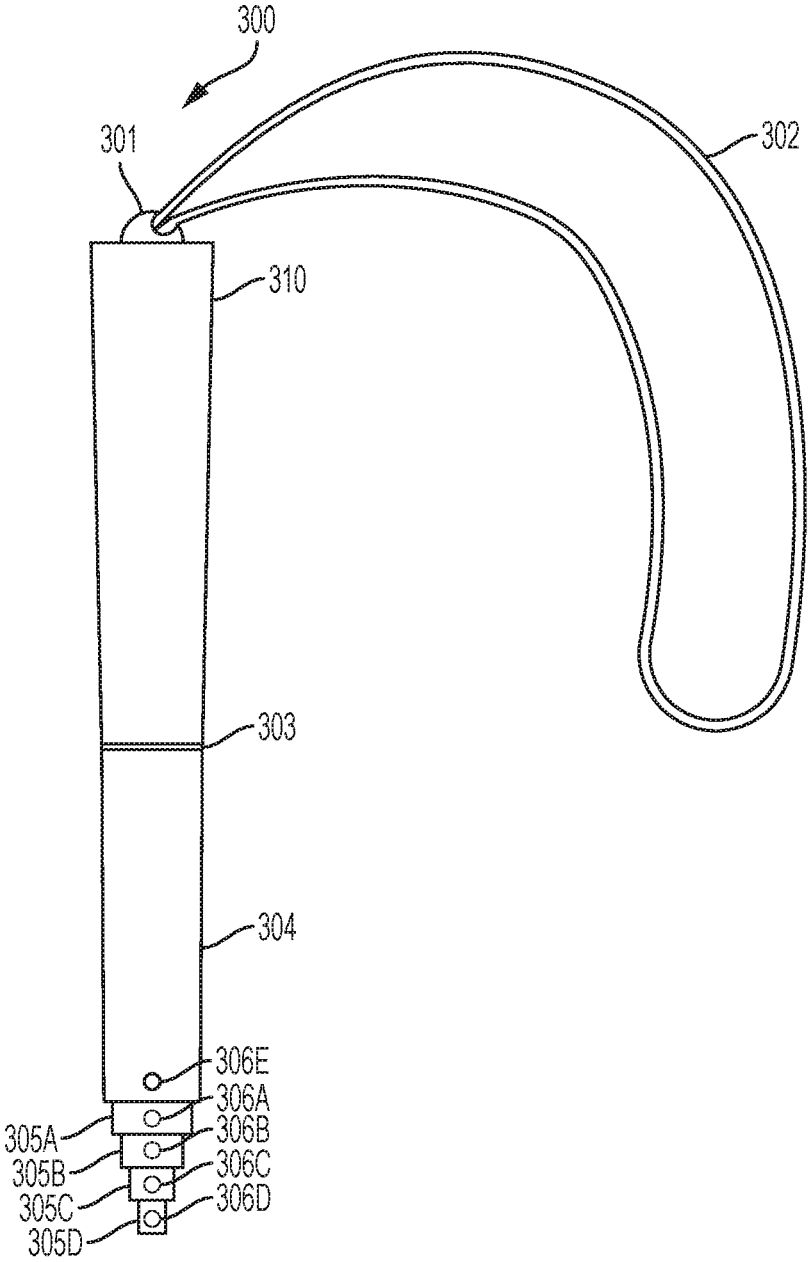
FIG. 3 shows a front view of the present Toe Jam foot and toe washer invention 300 but with the extension, referred to herein as a telescopic section retracted and no cleaning or medicating accessory attached. A depicted lanyard or wristlet 302 may make the foot and toe washer easy to carry in the shower or hang on a hold/cold water faucet and is tied or looped through an orifice (unnumbered) of a collapsible clip 301 at the end of handle 310 and the lanyard 302 may be wrapped around the wrist of a person taking a shower. Extension 304 is connected to the handle 310 via connector 303 and makes the foot and toe washer 300 about an inch in diameter and about a foot long (or less). Orifice (or slit) 306E of the extension 304 of the handle 310 allows a spring-loaded ball or button member (506B (FIG. 5)) at the top end of extension 305A to lock into orifice (or slit) 306E when extended; see FIG. 5. Extension 305A has orifice or silt 306A for a spring-loaded ball or button member of member 506B to lock into; extension 305B has orifice or slit 306E and so on. Altogether, for example, five one foot extensions could permit the foot and toe washer 300 to be, for example, five feet long. Even a seven foot tall person could reach their feet and toes in a cramped shower. The last orifice 306D is used to connect a sponge, wash cloth, brush, or other cleaning or medicating accessory or combination accessory as will be further explained herein.

There may be a handle extending the length to greater than 6-8 inches, for example, twelve to sixteen inches (see FIG. 3) and a string/lanyard/wristlet 302 (not shown in FIG. 6) for attachment to the wrist, a hot or cold shower water control or other shower location when not being used (see FIG. 3). The outer diameter or longest cross-sectional side may be, for example, 1", 2" or less with all other sections of the telescope "housed" in this Toe Jam foot and toe washer 600 (non-extended) shown (see FIG. 6). The between-the-toe washing accessory (FIG. 4A), sponge (FIG. 4B), or other cleaning or medicating accessory such as a cloth or a brush may be approximately 1-4" in length and approximately ¼"-1" wide and contain a soap or medicated soap dispenser 408 hidden inside (see FIG. 4B, compartment 408). These dimensions are exemplary and are not deemed to be limiting. A wash cloth, brush or other known washing accessory may replace a sponge (FIG. 4B) or an in-between toe washer (FIG. 4B) in alternative embodiments.

Figure 7A:
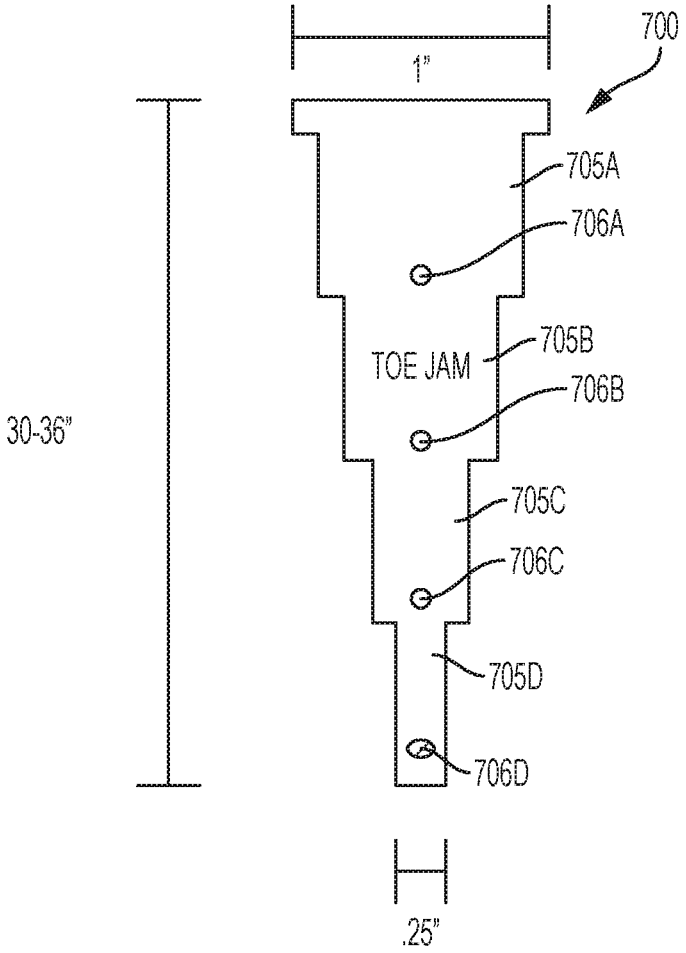
FIG. 7A is a diagram showing the present telescope portion 700 of the invention with the telescopic portion extended but no attachment per FIG. 4A or 4B. The cross-section may typically be circular and each extension fitted with a guiding rib (not shown) to align ball and orifice as extensions are extended. The Toe Jam is shown fully extended to a length of thirty to thirty-six inches and comprises, for example, four extensions. Extension 705A is a first extension that has an orifice 706A for catching a spring-loaded ball of second extension 705B when the first extension is extended and so on. The final width or diameter of the fully extended Toe Jam may be, for example, 0.25 inch having been originally one inch in diameter/width before extension.

As shown in FIG. 7A, in the fully extended position, the foot and toe washer 700 will be able to achieve a maximum desired length of approximately 24"-36" dependent upon design and production limitations. Its overall length would be three feet to four feet with the accessories (for example, FIG. 4A or FIG. 4B or other accessory) attached. Also, a preferred material for manufacture is a tough and resilient form of plastic so that the foot and toe washer 700 (and any springs) does not easily break, is not bendable and the plastic or plastic/metal spring portion of a spring-loaded ball and orifice lock (see FIG. 5) is preferably made of tough but resilient plastic. Some forms of tough rubber may also be used to make the present invention. As explained above, a circular cross-section may be used when a friction locking of extensions is used to extend the extensions, but a circular cross-section makes it difficult to align an orifice or slit with a ball or thin spring-loaded plastic locking member. So a rib protrusion on each mostly circular extension (not shown) may be used as guides for one another to align an orifice or slit with a spring-loaded locking member for locking extensions together and prevent circular extensions from rotating within one another so the locking mechanisms are aligned by the rib portions of the extensions.

Figure 1:
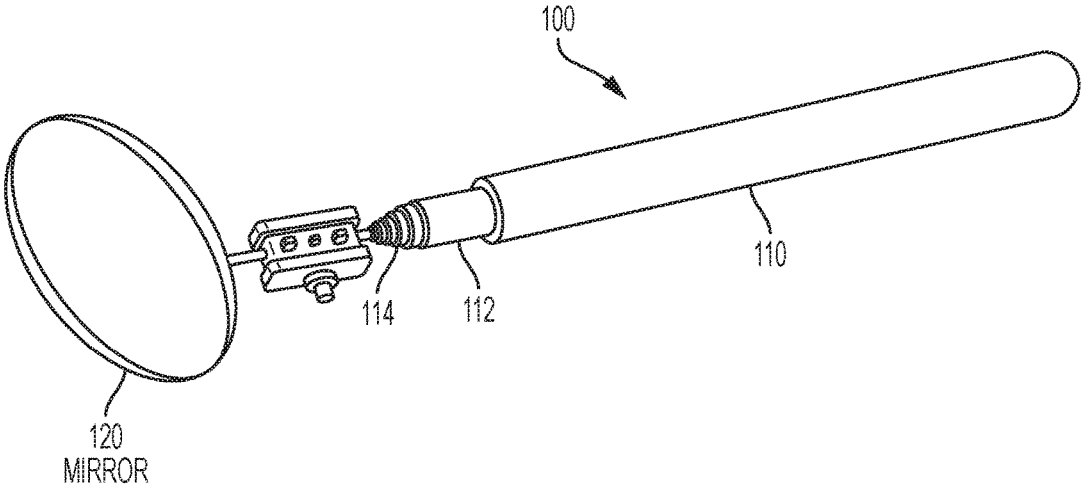
FIG. 1 PRIOR ART
FIG. 1 shows a prior art mirror 100 with a telescope design that is similar to that which may be used in the present invention. A spy mirror 120 may be attached to a clamp to clamp the mirror 120 in a desired position relative to the telescoping portion 110, 112, 114. The locking method for locking extensions appears to be the use of friction by increasing or decreasing the diameter of each extension (and handle) 110, 112, 114 at each end of an extension so the extensions may be held in place when extended by friction between the extensions when extended to their individual lengths.

Referring to FIG. 1, prior art with a similar telescopic design and grip is depicted. The prior art mirror device 100 shown in FIG. 1 consists of a handle 110, a telescopic portion 112 with the telescopic sections 114 in a retracted position, and a mirror 120 at the end connected by an un-numbered clamp and positioned in a desired position for spying. This device appears to use a friction-type of locking mechanism at ends of the extensions 114. As known in the prior art, a circular cross section may have an increased diameter and a roughed surface to twist and lock into an outer extension having a portion with reduced circular diameter. In this manner, as many extensions as needed, for example, to spy around a corner or see above a wall may be extended and locked by friction twisting until firm.

Figure 2A:
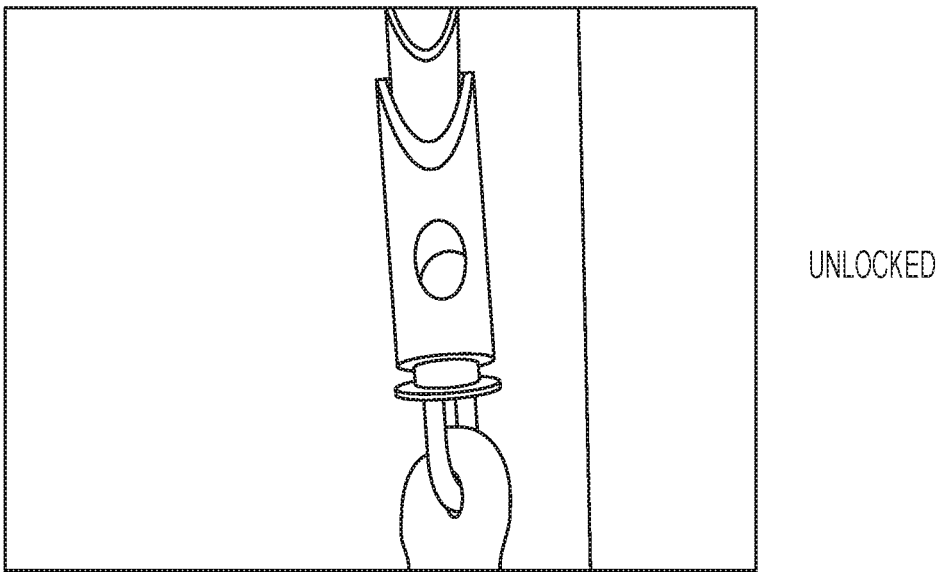
FIG. 2A PRIOR ART
FIG. 2A and FIG. 2B show prior art unlocking and locking with a similar locking mechanism that is similar to that which may be also used in the present invention comprising a spring-loaded ball in the inner extension (not seen in FIG. 2A representing an unlocked position) and a corresponding orifice in the exterior extension to receive and lock with the spring-loaded ball.
Figure 2B:
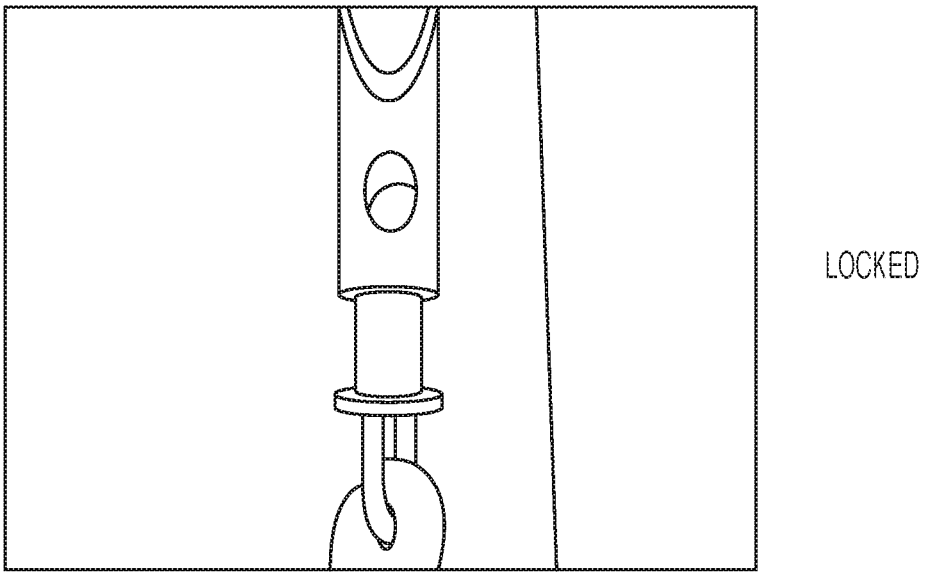
FIG. 2B PRIOR ART

Referring to FIG. 2A, a prior art spring loaded ball (made of plastic, hardened rubber or metal) is shown with a push button ball locking mechanism. The push button ball may be pushed to unlock the telescopic sections of the present invention in an extended position. When not locked as in FIG. 2A, the spring-loaded ball is wholly contained within the extension and/or to interchange accessories with the foot and toe washer. When locked as in FIG. 2B, the ball is seen locking the two extensions together with the ball resting and held by a spring in the appropriately sized orifice for receiving the ball and locking the extensions together.

Referring to FIG. 3, the Toe Jam foot and toe washer embodiment 300 of the present invention may consist of a, for example, rubber or other coated grip handle 310 and a toe washer extension 304 made, for example, of plastic that is durable, strong and does not easily bend. Joining section or connector 303 is shown joining the handle 310 to the extension 304 which handle/extension may extend the length of a handle/extension 310/304 to a length of, for example, eight to ten inches for housing further extensions 305A through 305D within the hollow interior of handle 310/extension 304. Extensions may fit in these in combination so the washer 300 may be of a selected length. The orifice 306E may permit the extension of first extension 305A to its entire length, for example. The orifice 306A is for receiving the first spring-loaded ball (see FIG. 5, ball or button 506B) of the next inner extension 305B. Extension 305A, in turn, may lock by friction to handle 301/extension 304 or may use a spring-loaded ball such as ball 506B received into orifice 306E when it is extended. Handle 310 may be permanently connected to extension 304 via connector 303. In the fully retracted position as seen in FIG. 6, the telescopic sections 305A, 305B, 305C, 305D are housed inside the handle/body 310/304 with different diameter springs 610, 615, if used, for quick extension to a desired length by spring-loaded push button control (see FIG. 6 pins 610A and 615A for spring release).

Referring again to FIG. 3, the telescopic sections 305A, 305B, 305C, 305D may begin and be housed at breaking point 303 or each telescopic section may reach through the handle/extension 310/304, both handle 310 and extension 304 of which may be hollow, the connecting point 303 located between the coated grip handle 310 and the extension 304. Each telescopic section 305A, 305B, 305C, 305D comprises a locking mechanism 306A, 306B, 306C, 306D, 306E such as (but not limited to) the locking mechanisms depicted in FIG. 2 and FIG. 5 or the friction type discussed above in the Background and seen in FIG. 1. A collapsible clip 301 (per FIG. 3) with an orifice may be attached to the top of the coated grip handle 310, and a lanyard or wristlet 302 may be used for hanging the foot and toe washer 300 on a cold or hot water control or wearing on one's wrist. The lanyard or wristlet 302 is tied, attached to or looped through the collapsible clip 301 and may be detachable if not desired to be used. The lanyard 302 also provides an easy way to hang the non-extended Toe Jam foot and toe washer 300 in a small locker on a hook.

The telescopic feature of the TOE JAM foot and toe washer may work by turning the wand clockwise or counterclockwise to loosen and extend, then counterclockwise or clockwise to tighten at the desired position (friction or twistedly grooved connection). The reverse process may be used to retract the telescopic foot and toe washer to the normally stowed position.

In another embodiment per FIG. 6, the telescopic feature may be extended by pushing a spring-loaded push button or spring-loaded ball, similar to the mechanism used to lock extensions of a collapsed umbrella known in the art. In an alternative embodiment, the telescopic feature may be extended by a flick of the wrist, such as, for example, the Smith and Wesson collapsible baton (available at https://www.basspro.com/Smith-&-Wesson-Heat-Treated-Collapsible-Batons-with-Sheath/product/12062804363910/).

The telescopic portion may be made of a durable plastic, organic polymer, rubber or other strong, water-resistant material such as a tough, hardened rubber so it will be strong and rigid, but also slightly flexible so it will not break or snap. It is especially useful in the shower or bath that it be rust-proof and not made of a material such as iron which may rust. Stainless steel may be another option for the telescope design of the TOE JAM (but heavy); however, the washing attachments may be plastic or sponge rubber or scrub brush material in order to decrease weight, better adhere to sponge or cloth material and provide more options to the overall design which will be slender in order to fit between a person's toes, but lengthy enough to be used for "side swiping" a person's back, legs, etc. if the user chooses to use it for other washing applications such as back-scrubbing. The entire unit assembled should not be in excess of one pound even when filled with medicating or non-medicating soap or medication alone.

Figure 4A:
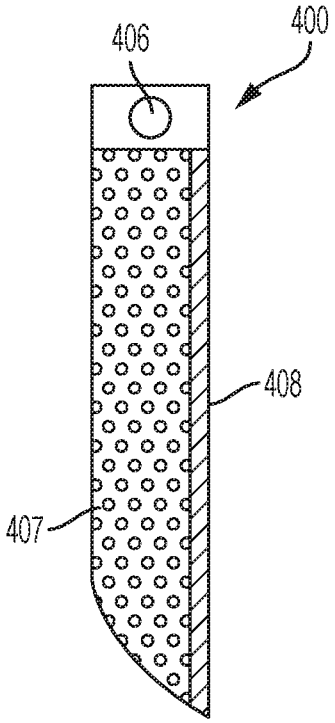
FIG. 4A shows a side view of an example of a cleaning accessory 400 which may be attached to the final extension body of the present invention comprising, for example, a spring-loaded ball 406 which may lock into place in the last orifice 306D via a suitably sized orifice that is deep enough to catch the ball in the telescopic last extension orifice 306D. If the Toe Jam foot and toe washer has fewer extensions, then, the ball 406 would be for capture in the last extension orifice or slit no matter how many extensions to the handle/first extension have been opened. This accessory 400 is intended for washing between toes and may be thin and flat ended and lock into place so as to not be intended to move except in directions to wash between toes.
Figure 4B:
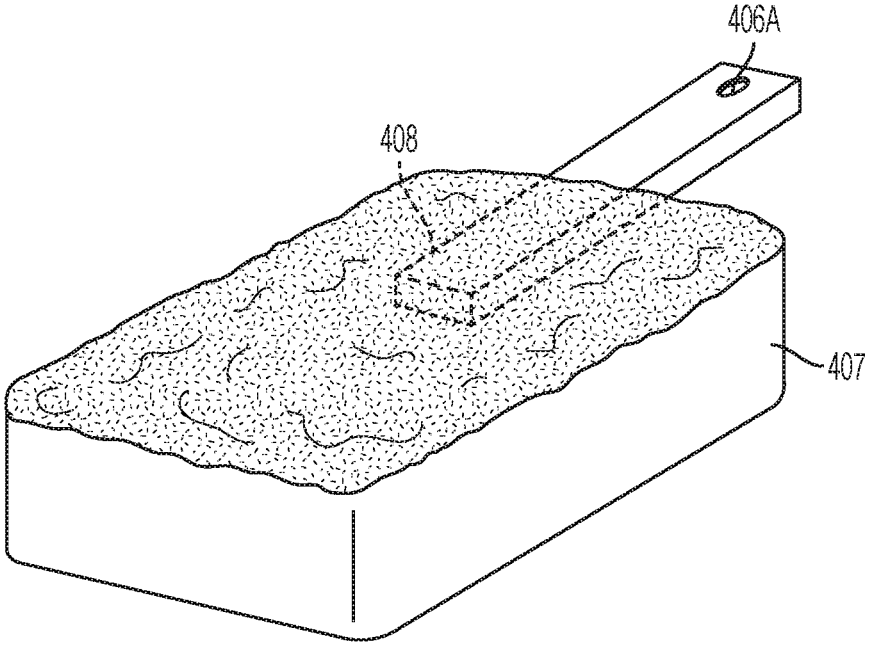
FIG. 4B shows a sponge 407 with similar material to that which may be used in the cleaning accessories of the present invention, for example, comprising a top, rough side and a soft bottom side and having an extension comprising, for example, a large to small diameter connecting piece or one with a spring ball 406A for attachment to the final extension orifice so as to be moved by the user and rigidly connected to the lowest telescopic section. Rigid compartment 408 may not only hold the cleaning tool 407 in place but may comprise a compartment for loading soap or medication. In alternative embodiments, sponge 407 may not be a sponge at all but comprise a wash cloth or a brush including an attachment piece including ball or slit 406A for receiving a ball or thin triangular member.

Referring to FIG. 4A, an example is shown of a cleaning accessory 400 that may be attached to the end of the foot and toe washer. Such accessory may be a tapered sponge with a soft sponge 407 for cleaning between toes, a coarse side 408 for scrubbing, and a hole, slit or spring-loaded ball or thin member 406 for a locking mechanism to connect the accessory to the body of the foot and toe washer and hold it. The cleaning accessory 400 may also comprise other shapes, sizes and materials and contain an embedded compartment for soap (soap/medication dispenser 408 in FIG. 4B).

Referring to FIG. 4B, there is shown a sponge that is known in the prior art but may be adapted to contain an accessory 406A which may comprise an associated orifice or spring-loaded ball 406A for joining to the last extension 305D of the telescopic Toe Jam foot and toe washer. The sponge is shown as an example of the material that may be used for the cleaning accessory shown in FIG. 4A. A small wash cloth may also be used as an alternative or in addition to the sponge or a brush (not shown). The sponge may consist of a soft sponge portion 407 with an embedded soap/medicated soap dispenser 408. A ball 405, 406A or an orifice 405, 406A may connect to its opposite end and lock the accessory into place.

Figure 5:
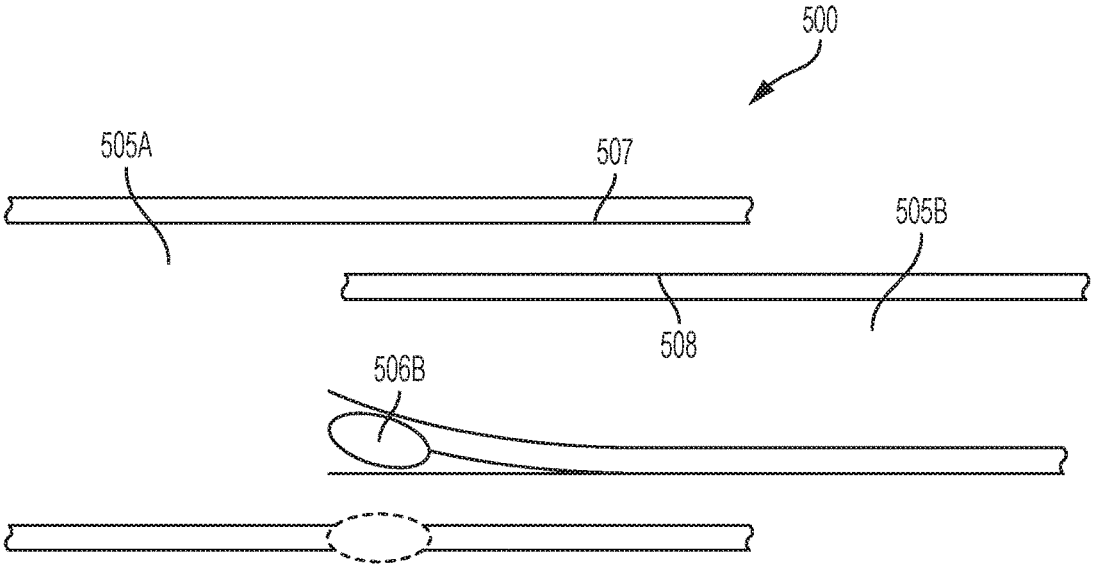
FIG. 5 shows a detailed cross-section example spring ball and orifice connection 500 of how the sections or extensions 507, 508 of the telescopic portion may be locked into an extended position. Space 505A of outer extension 507 is filled with inner extension 508. Typically, although not specifically shown, outer section 507 is directly proximate to inner extension 508. Inner extension 508 is moved from right to left (given extension 507 remains in the same place) until spring-loaded ball 506B is able to fall into and be captured by the dashed-line orifice of outer extension 507. Referring briefly to FIGS. 7B, 7C and 7C, there are shown cross-sectional views that are exemplary for showing that if a Toe Jam toe washer is perfectly round, the extensions 507 and 508 would never lock to one another unless a user twists the extensions 507 and 508 so that the dashed line orifice or slit of the outer extension 507 aligns perfectly with the inner extension 508. An oval, a square or a rectangular cross-section will force the spring-loaded ball 506B or thin spring-loaded member to align with the orifice or slit. If a person is small they may use fewer extensions than are provided to wash their feet and toes or to reach their backs.

FIG. 5 shows a further, more detailed example of a locking mechanism 500 that may be used to hold the telescopic sections 505A, 505B of the present invention in an extended position. Walls 507 may comprise an outer extension and walls 508 may comprise an inner extension with the distance between extensions exaggerated. (The extensions 507 and 508 will be closer together so that the spring-loaded ball 506B will be captured and the extensions locked to one another by the dashed-line orifice in the bottom wall 507. The locking mechanism 500 (shown about to lock in solid line and locked in dashed line) consists of a ball or button 506B that is spring-loaded and locks into an opening or orifice or slit that may be smaller in diameter than the ball, thin locking member. Spring-loaded ball 506B operates in the same manner as a spring-loaded push-button 610A or 615A (FIG. 6) or the dashed line orifice is deep enough to catch half of the spring-loaded ball 506B in the wider telescopic section 505A when the narrower telescopic section 505B is pulled out to an extended position and the ball or button 506B is aligned with the dashed line opening. The inner edge of the wider telescopic section hollow interior 505A may have a groove (not shown) and the outer edge of the narrower telescopic section 505B has a corresponding ridge which fits into the groove and so prevents the telescopic sections 505A, 505B, 507, 508 from rotating relative to one another with 505B, 508 extension being within exterior extension 505A, 507. But see cross-section drawings FIG. 7B (oval), FIG. 7C (square) or FIG. 7D (rectangular) which would automatically prevent undesired rotational movement of one extension inside another if a slit or orifice are used to capture a ball or thin spring-loaded triangular member.

Referring to FIG. 6, there is shown an exemplary foot and toe washer of the present invention with embedded springs 610 and 615, for example, located inside a handle portion 310 (FIG. 3). First spring 610 may be, for example, an eight inch long plastic compression spring that when collapsed is held by pin 610A until it is pushed and released from being compressed. First spring 610 in its extended state may be twenty inches long and has a diameter $D_1$ that equals the diameter of the second extension, passes through the second extension and pushes against the smaller diameter of the third and final extension. So when pin 610A is pushed compression spring 610 is released, the spring 610 may then push against the third extension and all three extensions reach their full lengths and lock together by their respective spring-loaded balls and orifices. Now spring 615 may be four inches long in a compressed state and rest on a platform and have a diameter $D_2$ that is larger than diameter $D_1$ and be the inner diameter of the handle 310 plus extension 304. Spring 615 only pushes against the first extension from its collapsed state when its respective spring-loaded pin 615A or push button is pushed to release the spring so that the foot and toe washer becomes only about sixteen to twenty-four inches long and the final extension is not extended. Being sixteen to twenty-four inches long, a wash cloth may be added to the third extension and be used to wash hard-to-reach places such as one's back.

Figure 7B:
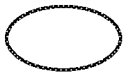
FIG. 7B shows a further typical cross-section of the telescope portion seen in side or cross-sectional view in FIG. 7A comprising an oval shape which precludes rotation of inner extensions. An oval shape is one shape which prevents each respective inner extension from rotating within its associated next outer extension. Other exemplary cross-sectional shapes which preclude rotational movement of extensions are a square cross-section seen in FIG. 7C and a rectangular cross-section seen in FIG. 7D. When friction is used to tie extensions together as seen in FIG. 1, a cross-section may be circular and, as has been or will be explained, have tapered ends and perhaps a rough surface to increase fiction and locking force of telescopic extensions.
Figure 7C:
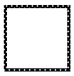
Figure 7D:
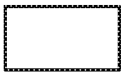

Now other ways of preventing rotation of the foot and toe extender will be discussed. The friction locking of extensions may have a circular cross-section and a screw groove or friction locking. Ways of preventing rotation of one extension within another extension are discussed with reference to cross-section FIGS. 7B, 7C and 7D. The telescopic foot and toe washer and ball or button 506B and corresponding opening or orifice may have an oval cross-sectional shape as shown in FIG. 7B, or it may be round (friction mounting or fitted with a ridge and groove in each telescopic section) or square (FIG. 7C) or rectangular (FIG. 7D) (all with spring loaded ball and orifice or slit/triangular member locking or friction locking). The locking mechanism may comprise a button and opening on one side of the telescopic section and a groove and ridge on the other side, as depicted in FIG. 5. In one embodiment, the locking mechanism may comprise multiple balls, push buttons and openings, for example, one on each side of each telescopic section. As many extensions as desired may be extended and used so that people of all ages and heights may use the foot and toe washer for different purposes than just foot and toe washing by using springs of different diameters and different extended lengths. Or the plastic compression spring loading may be used to automatically extend the foot and toe washer to foot length or back length by the pushing of a spring-loaded button.

A push button locking mechanism, such as the mechanism depicted in FIG. 2, may allow owners to interchange accessories that come with the TOE JAM foot and toe washer such as the between-the-toes accessory of FIG. 4A and the sponge washer of FIG. 4B or a wash cloth or a brush or other cleaning/medicating accessory. Simply press the button or ball or thin locking member and push them into position until you hear/see the accessory lock into place, or you press the button and pull the accessory off for storage, movement back into its outer extension or for replacement purposes. The same concept could also apply and be used in the form of a twist and lock at the "bitter end" of the telescope for attaching and removing accessories. Similar locking mechanisms may be used to lock the telescopic sections in an extended position.

The initial design concept will allow the TOE JAM foot and toe washer accessories to support a medicating foot cleaner, as well as a non-medicating cleaner (see hidden soap/medicated soap dispenser 408 of FIG. 4B). Both accessories will be designed primarily for feet or toes, but as stated, can also be used and substituted as a back washer, leg washer, etc. The washers would be the same design and be compact to fit in a locker; however, one may have a hinged "see-though" plastic door allowing access to a chamber 408 (not shown but hidden in sponge) that can be filled with medicating or non-medicating soap. As the individual washes, the soap will be absorbed into the sponge and applied as desired with little effort. The chamber 408 may be able to hold 1-4 ounces of soap of either medicating or non-medicating type. The accessory used without the self-absorbing soap in the chamber 408 can be used in anyway desired by the purchaser.

Here is a list of some additional enhancements to embodiments of the TOE JAM foot and toe washer and its accessories:

Compact storage i.e. in shower, next to tub, in a closet, locker or travel bag.

The main body of the telescopic handle may have a "non-skid" type grip/handle 310 to prevent the TOE JAM foot and toe washer from slipping out of your hand while washing (or use the wristlet 302).

The foot and toe washer can be easily stowed in a linen closet, a locker or hung on a shower rack or water controls by the lanyard or wristlet 302 attached to the handle. The nylon, dacron or polypropylene lanyard or wristlet 302 attached to the handle 310 (for example, the wristlet, lanyard being $1/16^{th}$ to $1/8^{th}$ inch in diameter) will allow for easy shower rack storage and not take up space as, for example, hair razors do.

While various aspects of the present invention have been described above, it should be understood that they have been presented by way of example and not limitation. It will be apparent to persons skilled in the relevant art(s) that various changes in form and detail can be made therein without departing from the spirit and scope of the present invention. Thus, the present invention should not be limited by any of the above described exemplary aspects, but should be defined only in accordance with the following claims and their equivalents.

In addition, it should be understood that the figures in the attachments, which highlight the structure, methodology, functionality and advantages of the present invention, are presented for example purposes only. The present invention is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What is claimed is:

1. A foot and toe washer comprising:

a hollow handle portion having a coated grip, a retention clip, and one of a lanyard and wristlet for use with the retention clip, the hollow handle portion having a cross-section that is one of oval, rectangular and square, a hollow extension portion located one of integral with or inside the hollow handle portion having a corresponding cross-section to that of the hollow handle portion precluding the hollow extension portion from moving in other than a longitudinal direction, a plurality of hollow extension telescopic sections comprising an elongated telescopic section connectable to and adapted to be located within the hollow extension portion and the hollow handle portion, the elongated telescopic section also having a corresponding cross-section precluding the hollow extension telescopic sections from moving in other than a longitudinal direction, one hollow extension telescopic section of the hollow extension telescopic sections being locked into place in an extended position within the hollow extension portion and the hollow handle portion by a locking mechanism of one of a spring-loaded ball being received within a small orifice and a thin triangular member and a respective thin slot for receiving the thin triangular member and further comprising a further locking mechanism at a distal end of the foot and toe washer for connecting a cleaning accessory.

2. The foot and toe washer of claim 1 further comprising:

a cleaning accessory comprising a tapered sponge with a soft sponge component having a coarse sponge component, the cleaning accessory having one of an oval, a rectangular and a square cross-section having a spring-loaded ball for being held in a most distal hollow extension telescopic section from the coated grip.

3. The foot and toe washer of claim 2 further comprising a compartment of the cleaning accessory for dispensing one of soap and medication into the cleaning accessory and adapted for washing tops and palms of feet.

4. The foot and toe washer of claim 2, the cleaning accessory adapted to be thin and comparatively long and adapted to be used for washing between toes of feet.

5. The foot and toe washer of claim 2 where the cleaning accessory comprises one of a spring-loaded ball and a thin triangular locking member for mating with and locking with an orifice or slit of a last hollow extension telescopic section at a distal end of the foot and toe washer.

6. The foot and toe washer of claim 1 having first and second releasable springs to extend the foot and toe washer to one of an intermediate length and a fully extended length.

7. The foot and toe washer of claim 6 wherein each releasable spring has an associated spring-loaded releasable push button.

8. The foot and toe washer of claim 1 where a first hollow extension telescopic section at the hollow handle portion and hollow extension portion end of the foot and toe washer has a cross-section that is one of oval, square or rectangular for preventing rotational movement of a second hollow extension telescopic section inside a first hollow extension telescopic section within the hollow handle portion and the hollow extension portion.

9. The foot and toe washer of claim 1 having one of a width and height at a distal tip of the foot and toe washer smaller than a width or height of the hollow handle portion and hollow extension portion of the foot and toe washer and a hollow extension telescopic section of the foot and toe washer having a smaller corresponding width and height at an intermediate length from the hollow handle portion and hollow extension portion to the distal tip of the foot and toe washer and the foot and toe washer having a distal hollow extension telescopic section having a smaller width and height than those of the hollow extension portion or the hollow handle portion so that any hollow extension telescopic section may not rotate within the hollow handle portion and hollow extension portion, and only be extended until locked at an extended length.

10. The foot and toe washer of claim 1 having an extended length of between twenty-four and thirty-six inches and a compact length of between eight and sixteen inches.

11. The foot and toe washer of claim 1 having a handle having one of a width and height no greater than two inches in cross-section.

12. A foot and toe washer comprising:

a hollow circular handle housing portion having a coated grip, a retention clip, and one of a lanyard and wristlet for use with the retention clip, a hollow circular extendible handle portion located one of integral with or inside the hollow circular handle housing portion, a hollow circular body comprising a plurality of hollow circular extensions connectable to and located within the hollow circular extendible handle portion and the hollow circular handle housing portion, each successive hollow circular extension of the hollow circular body being locked into place in an extended position with respect to the hollow circular extendible handle portion by means of friction or twisting such that the circular diameter of the hollow circular extendible handle portion narrows to approximately equal the circular diameter of the one first hollow circular extension of the hollow circular body and the one first hollow circular extension and hollow circular extendible handle portion being held together by friction, the hollow circular handle housing portion and the hollow circular extendible handle portion having a rough internal surface and the one first hollow circular extension of the hollow circular body having a rough outer surface increasing the amount of friction between each of the hollow circular handle housing portion, the hollow circular extendible handle portion and the one first hollow circular extension of the hollow circular body.

13. The foot and toe washer of claim 12, the hollow circular body of the foot and toe washer having a distal end having a circular diameter and the hollow circular handle housing portion having a larger circular diameter than the circular diameter of the distal end of the hollow circular body.

14. The foot and toe washer of claim 13, the foot and toe washer distal end having a locking mechanism adapted to receive interchangeable accessories comprising one of a sponge and a between-the-toe washer.

15. The foot and toe washer of claim 14, the sponge having an internal compartment for one of soap and a medication.

16. The foot and toe washer of claim 15, the medication comprising medication for treatment of Athlete's foot.

17. The foot and toe washer of claim 13, the foot and toe washer comprising four hollow circular extensions fitting within the hollow circular handle housing portion and the hollow circular extendible handle portion, each of the four hollow circular extensions having a progressively smaller diameter and each hollow circular extension adapted to be twisted and locked by friction when extended into an associated next hollow circular extension of the hollow circular body.

18. The foot and toe washer of claim 12 having four hollow circular extensions increasing the overall length of the foot and toe washer to an extended length between twenty-four and forty-eight inches.

19. The foot and toe washer of claim 12 further comprising alternative accessories for attachment to the distal end of the foot and toe washer comprising one of a wash cloth and a brush.

* * * * *